United States Patent [19]

Niskanen et al.

[11] 4,435,122

[45] Mar. 6, 1984

[54] METHOD AND APPARATUS FOR PUMPING FIBER SUSPENSIONS

[75] Inventors: Toivo Niskanen, Hamina; Frey Sundman; Jorma Tuomaala, both of Karhula, all of Finland

[73] Assignee: A. Ahlstrom Osakeyhtio, Noormarkku, Finland

[21] Appl. No.: 239,427

[22] Filed: Mar. 2, 1981

Related U.S. Application Data

[63] Continuation-in-part of Ser. No. 903,494, May 8, 1978, abandoned.

[30] Foreign Application Priority Data

May 16, 1977 [FI] Finland ..... 771541

[51] Int. Cl.[3] ..... F04D 1/04

[52] U.S. Cl. ..... 415/121 B; 415/219 C; 406/92

[58] Field of Search ..... 415/143, 182, 213 A, 415/121 R, 121 B, 219 C; 406/86, 92, 100, 101, 102

[56] References Cited

U.S. PATENT DOCUMENTS

| | | | |
|---|---|---|---|
| 3,316,848 | 5/1967 | Egger | 415/213 A |
| 3,973,866 | 8/1976 | Vaughan | 415/143 X |

FOREIGN PATENT DOCUMENTS

| | | | |
|---|---|---|---|
| 176507 | 3/1953 | Austria | 406/102 |
| 1211905 | 3/1966 | Fed. Rep. of Germany | 366/315 |
| 2818540 | 11/1978 | Fed. Rep. of Germany | 415/121 B |
| 45412 | 2/1962 | Poland | 415/143 |
| 258773 | 11/1970 | U.S.S.R. | 415/205 |

OTHER PUBLICATIONS

Sence, L. H.; *Centrifugal Pumps for Paper Stock Handling*, Chemical 26, 4(1960), 12, pp. 22–36.

*Primary Examiner*—Philip R. Coe
*Assistant Examiner*—Christine A. Peterson
*Attorney, Agent, or Firm*—Bucknam and Archer

[57] ABSTRACT

The disclosure describes a method and a device for pumping fiber suspensions of high consistency. Shear forces disrupting fiber flocs are induced near the front edge of the vanes of the impeller in a centrifugal pump which fluidize the fiber suspension hereby converting it into an easily pumpable state. This is effected by an inlet part having recesses and/or lobes in its inner surface in front of the impeller which cooperate with a rotor having an outer surface in which there are recesses and/or lobes disposed into the inlet part.

2 Claims, 4 Drawing Figures

METHOD AND APPARATUS FOR PUMPING FIBER SUSPENSIONS

This application is a continuation-in-part of U.S. Ser. No. 903,494, filed May 8, 1978, now abandoned.

The present invention relates in general to a method and an apparatus for pumping fiber suspensions and is particularly intended to be applied in centrifugal pumps for fiber suspensions of high consistency.

Centrifugal pumps may be used successfully in the paper and cellulose industry for pumping fiber suspensions or pulps having consistencies less than 6% on condition that the pump has been correctly designed and that its input pressure is adequately high. A centrifugal pump is not, however, suitable for high consistency pulps because due to flocculation of the pulp, the pump will be clogged. Expensive pumps based on the displacement principle must, therefore, be used for pumping high-consistency pulps.

It is an object of the invention to provide a method and an apparatus which makes it possible to use centrifugal pumps for pumping pulps of considerably higher consistencies than until now.

Another object of the present invention is to subject the pulp suspension to such shear forces that fluidization is achieved. Fluidization is the state where solid particles can move freely past each other. In a pulp suspension in water, the solid fibers are converted into a form that the fiber-to-fiber bonds are disrupted and the suspension behaves in a manner similar to a uniform liquid.

The state of fluidization with the apparatus according to the present invention is achieved by subjecting the pulp to shear stresses which disrupt the fiber-to-fiber bonds by causing the pulp to go through a flow passage formed by a non-round rotor in a non-round inlet, the cross-section of which alternately decreases and increases so that flow components directed alternately towards the rotational axis of the rotor and away from it as formed.

According to the invention, this is achieved by generating shear forces in the pump in front of the impeller or/and at the front edge of the impeller vanes, which disrupt fiber agglomerations or flocs formed in the fiber suspension. The invention is based on the fact that the fiber suspension, when being subjected to forces disrupting fiber-to-fiber bondings, becomes fluidized, i.e. is converted into an easily pumpable state. Compared to a conventional centrifugal pump, a pump according to the invention operates at a lower inlet pressure.

It should be stressed that in a fiber suspension of consistency above 6%, the fibers tend to form flocks which interlock to form a coherent network and which goes through a pipe like a solid, giving plug flow. Most efforts with high consistency pulps have been carried out in an effort to achieve a high degree of agitation and turbulence so that air bubbles are prevented from building up ahead of the impeller inlet. Undoubtedly, this gives some advantages, but agitation requires high energy expenditure. The method and apparatus according to the present invention are based on the finding that at a high shear rate, flocs are dislodged from the network and disrupted, so that the pulp is converted in easily pumpable form because it is fluidized.

An apparatus according to the invention can e.g. be used for discharging pulps of consistencies from 5 to 25% from pulp vessels. According to known methods, pulp is discharged from a vessel by mechanical devices such as transport screws or rotating scrapers. Discharge of high-consistency pulps requires much energy and robust constructions. Vibrating devices e.g. based on ultrasonic waves have been suggested to be used for discharging pulps from vessels but in practice these have been proved ineffective. When high-consistency pulps are discharged from large vessels, the pulp is usually diluted in front of the outlet in order to make it flow out.

In an embodiment according to the invention, the pump is disposed into the outlet of the pulp vessel whereby a rotor running through the inlet part of the pump and the outlet of the pump vessel fluidizes the pulp so that it can flow into the pump underneath due to gravitational forces.

The invention is described in more detail below with reference to the enclosed drawings in which FIG. 1 shows a vertical sectional view of one embodiment of the apparatus according to the invention.

Figure 1:
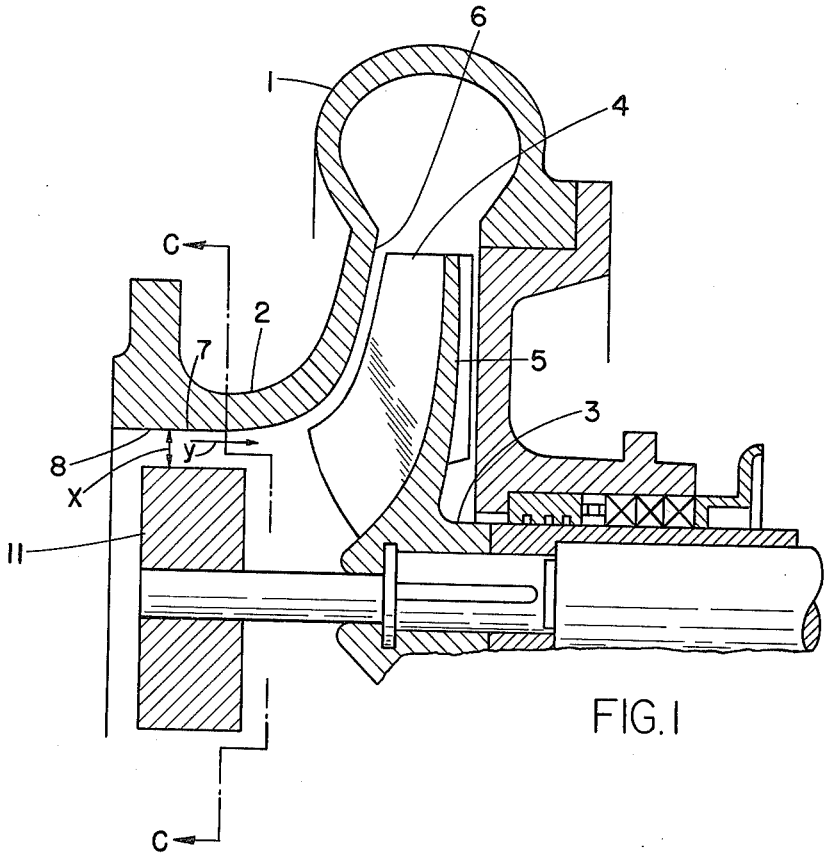
Figure 2:
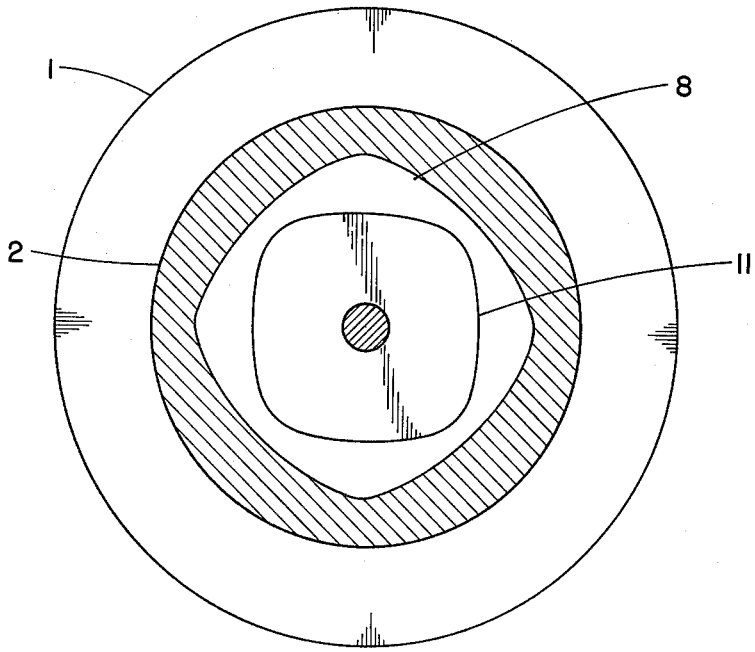
FIG. 2 shows a section along line C—C of FIG. 1.

In FIGS. 1 and 2 the numeral 1 refers to a pump housing which includes an inlet part 2. In the housing there is an impeller 3 rotatably journalled and having vanes 4 and a back wall 5. One side of the impeller is open and the inner surface 6 of the pump housing having the form of the vane edge guides the flow. Recesses 7 are in the inner surface of the housing by the front edge of the vanes. The outline 8 of the cross-section of the inlet part 2

While the rotor rotates, the fiber suspension in the inlet part is also brought into rotating motion, and because of the non-round cross section, subjected to shear forces as the cross-section in the direction of the rotation alternately increases and decreases. Hereby, the fiber suspension becomes fluidized just in front of the impeller and flows unhindered to the vane passages of the impeller.

In this apparatus as shown in FIGS. 1 and 2, a non-round rotor 11 has been disposed into the inlet part 2 of the pump, the cross-section outline of which is non-round. This enhances the rotating motion of the fiber suspension and the fluidization in the inlet part.

If necessary the pulp vessel may be provided with several outlets each of which is connected to a pump.

EXAMPLE 1

A rotor according to FIGS. 1 and 2 in the inlet part in front of the impeller had the following dimensions:

Max. diameter—85 mm,

Min. diameter—75 mm.

The corresponding dimensions of the inlet part were 150 mm and 130 mm.

Number of revolutions—1500 1/min,

Flow rate—3000–7500 1/min.

Tests have proved that a pump according to the invention is well adapted for pumping various pulps used in the paper and cellulose industry having consistencies from 8 to 12%. It is possible to pump pulps of even higher consistencies. When the consistency is less than 6%, the pump operates at an inlet pressure which is 2 to 3 meters (water head) lower than a conventional pulp pump.

Figures 3A, 3B:
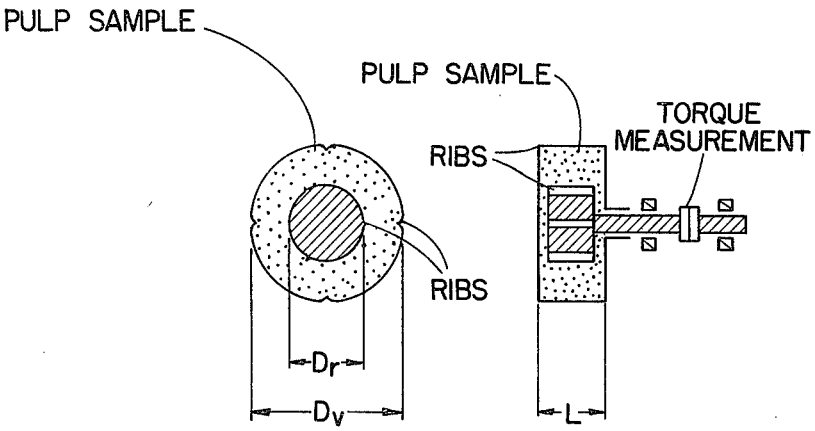
FIG. 3 illustrates an apparatus according to the present invention used to make torque measurements. The apparatus comprises a vessel provided with internal ribs and a rotor with external ribs.

The following theoretical considerations and tests show that fluidization is achieved by the apparatus and method of the present invention. At the outset, extrapolative calculations show that a 10 percent suspension requires velocities up to 40–50 m/s before fluidization is achieved. This exceptionally high velocity suggests that fluidization is not achieved with flow velocity but is achieved by utilizing shear between surfaces in relative motion. A device according to FIG. 3 was built. A high shear field is generated between the rotating element and the vessel walls by bringing the rotational speed up to 3000 rpm. The rotor is mounted on a shaft extending through the wall of the vessel. The shaft is connected to a variable speed drive motor (not shown). A torque measurement device is disposed between the shaft ends of the rotor and the motor. A series of tests was carried out with the vessel filled with pulp of 4%, 6%, 8%, 10% and 12% consistency. The face of the device is transparent to allow visual observation. Detailed motional patterns can be studied by colouring the liquid dark.

Figure 4:
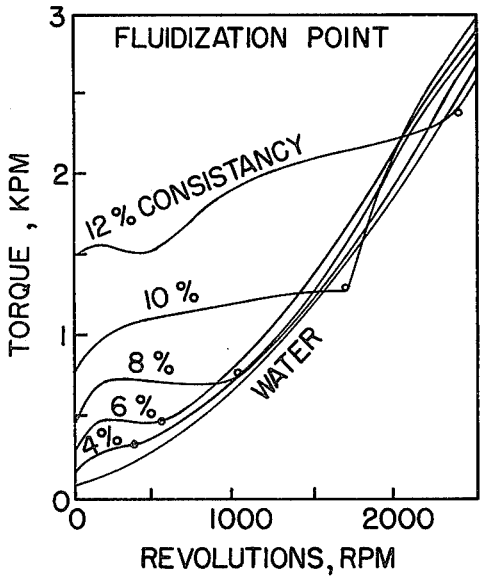
FIG. 4 is a plot of torques on the ordinate and rotational speeds on the abscissa in experiments according to the present invention.

Recordings of torque versus rotational speed yielded curves like those of FIG. 4. The sharp change indicated by a dot is always close to the water curve and coincides with the points where the whole vessel content becomes fluidized. The turbulent movement is too rapid to be seen by eyesight but is clearly visible on ultrarapid film taken at speeds in excess of 300 frames per second.

The disruptive shear stress at the vessel wall can be calculated as follows:

$$\tau d = \frac{2 \times M_d}{\pi \times D_v^2 \times L} \quad (1)$$

where $\tau d$ is disruptive shear stress in $N/m^2$ $M_d$ is torque at network disruption point in Nm $D_v$ is vessel diameter in m, and L is vessel length in m.

Applying the data measured with a system where the rotor diameter was 100 mm, vessel diameter 213 mm and ribs 10 mm high gave the constants in equation 2 as follows:

$$\tau d = kC^{\alpha} \cdot N/m^2 \quad (2)$$

where C is consistency in %

| | k | α |
|---|---|---|
| Bleached pine kraft | 27.3 | 1.98 |
| Semibleached pine kraft | 27.3 | 1.94 |
| Unbleached pine kraft | 18.9 | 2.04 |
| Spruce ground wood | 6.7 | 2.43 |

The data above show that fluidization is achieved by application of shear stresses.

The invention is not limited to the embodiments presented here but several modifications can be made of it without departing from the principle of the invention. E.g. the rotor in front of the impeller can rotate at a different angular speed than the impeller 4.

What is claimed is:

1. A method of fluidizing and pumping a fiber suspension with a centrifugal pump in the fluidized state; said pump having an inlet which has a conduit; a housing, an impeller with vames, an outlet and a non-round rotor which is located in the inlet of the pump, the inlet having recesses on its surface, which comprises feeding said fiber suspension into the conduit of the inlet; causing the rotor to rotate, bringing the fiber suspension into rotating motion in the inlet of the pump, said rotating motion having alternate flow components towards and away from the rotation axis of the rotor whereby shear forces are generated in the inlet of the pump which disrupt the fiber-to-fiber bonds whereby the fiber suspension is fludized, becomes pumpable and flows to the impeller in a fluidized state.

2. A pump for fluidizing a fiber suspension and pumping the fiber suspension in the fluidized state which comprises an inlet having a non-circular cross-section, and recesses in the inlet, the cross-section of the inlet alternately decreasing and increasing, a housing, an outlet, an impeller having impeller vanes and means located in the inlet for subjecting the fiber suspension to shear forces in the inlet, which means comprise a rotor, said rotor having a non-round cross-section.

* * * * *